US009024718B1

(12) United States Patent
Muse

(10) Patent No.: US 9,024,718 B1
(45) Date of Patent: May 5, 2015

(54) KEY HOLDER

(76) Inventor: Dorothy Muse, Silver Springs, MD (US)

( * ) Notice: Subject to any disclaimer, the term of this patent is extended or adjusted under 35 U.S.C. 154(b) by 438 days.

(21) Appl. No.: 13/450,842

(22) Filed: Apr. 19, 2012

Related U.S. Application Data

(60) Provisional application No. 61/595,318, filed on Feb. 6, 2012.

(51) Int. Cl.
*A45C 11/32* (2006.01)
*E05B 19/00* (2006.01)
*G07C 9/00* (2006.01)

(52) U.S. Cl.
CPC ..... *E05B 19/0005* (2013.01); *G07C 9/00896* (2013.01); *G07C 9/00174* (2013.01)

(58) Field of Classification Search
CPC ..... E05B 19/0005; E05B 35/086; G07C 9/00174; G07C 2009/00936; G07C 9/00896
USPC ..... 340/5.1, 5.2, 5.51, 5.6, 5.61, 5.62, 5.64, 340/5.7, 5.71
See application file for complete search history.

(56) References Cited

U.S. PATENT DOCUMENTS 3,742,741 A 7/1973 Cahan
3,867,823 A 2/1975 Waltower
3,992,792 A * 11/1976 Keller ..... 40/377
4,037,439 A * 7/1977 Youd ..... 70/456 R
4,273,427 A * 6/1981 Bailey ..... 353/27 A
4,946,030 A 8/1990 Guridi et al.
5,865,307 A 2/1999 Friedman
6,244,439 B1 * 6/2001 Dennis ..... 206/457
6,418,766 B1 7/2002 Luebeck
6,994,238 B2 * 2/2006 Estabaya ..... 224/667
7,513,633 B2 * 4/2009 Ermeti ..... 362/84
2002/0100784 A1 8/2002 Baird
2004/0112099 A1 6/2004 Randall
2006/0027005 A1 2/2006 Gill

* cited by examiner

*Primary Examiner* — Jennifer Mehmood
*Assistant Examiner* — Yong Hang Jiang
(74) *Attorney, Agent, or Firm* — Gold & Rizvi, P.A.; Glenn E. Gold

(57) ABSTRACT

A key holder for house and car keys has a wall around a circular periphery and a rear chamber. The housing has upper chamber with a cover and an aperture at the front. A door encloses a lower chamber containing tools. A carousel, rotatably mounted within the upper chamber, has an annular ring to receive the mounting holes of the house keys in angular spaced relation around the perimeter. The carousel stores the keys with the distal ends extending radially inward. The carousel allows selective pivotal deployment of the keys with the distal end extending radially outward through the aperture. An electric motor, a solenoid, and a controller with a voice recognition circuit rotate the carousel to deploy the keys. The rear chamber receives the car key, fob, and electronics. A handle, a belt clip, and flashlight are attached to the housing.

22 Claims, 3 Drawing Sheets

Additional Reference Numbers and Respective Leader Lines Added In Red.

Additional Reference Numbers and Respective Leader Lines Added In Red.

Additional Reference Numbers and Respective Leader Lines Added In Red.

Additional Reference Numbers and Respective Leader Lines Added In Red.

KEY HOLDER

CROSS-REFERENCE TO RELATED APPLICATIONS

This Non-Provisional Utility application claims the benefit of U.S. Provisional Patent Application Ser. No. 61/595,318, filed on Feb. 6, 2012, which is incorporated herein in its entirety.

FIELD OF THE INVENTION

The present disclosure generally relates to an apparatus and method for storing and deploying house keys in a rotating carousel.

BACKGROUND OF THE INVENTION

This invention relates to the field of keys and more particularly to a key holder with rotating key storage.

It is an often occurring problem that one fumbles with a ring full of keys to identify the proper key by visual clues of shape, size, color, and hole pattern, in order to enter a building. This becomes more difficult in darkness, more unpleasant in the rain, and more dangerous in a city neighborhood. The more keys one has, the longer this takes.

Accordingly, there is a need to provide a key holder that can store many keys in one place and allow retrieval of the proper key quickly.

There is a further need to provide a key holder of the type described and that will allow retrieval of the proper key in darkness by voice command, and provide a flashlight to illuminate the keyhole.

There is a yet further need to provide a key holder of the type described and that is operable manually in case the battery should fail.

There is a still further need to provide a key holder of the type described and that fits into a purse or clips onto a belt for easy carry and access.

There is another need to provide a key holder of the type described and that can be manufactured cost-effectively in large quantities of high quality.

SUMMARY OF THE INVENTION

In accordance with the present invention, there is provided a key holder for use in connection with house and car keys. The key holder has a housing with a rear chamber. The housing has a circular floor with a periphery. The housing has a wall around the periphery and rear chamber. The wall extends from the floor upward to an upper edge, and from the floor downward to a lower edge. The housing has an upper (a main) chamber above the floor and a lower (an auxiliary) chamber below the floor. The wall has a wall aperture therethrough at the front and extending from the floor to the wall upper edge. The rear chamber has a car key aperture adapted to receive the car key.

A cover encloses the upper chamber and has a cover aperture therethrough extending radially outward at the front. The cover has a cover door to close the cover aperture. A lower door encloses the lower chamber. The lower door pivots between a closed position and an open position.

A carousel is rotatably mounted within the upper chamber. The carousel has a plurality of spokes extending from a central hub outward to an annular ring. The annular ring receives the mounting hole of the each of the house keys in angular spaced relation around the perimeter. The carousel stores the keys in a storage position with the distal ends extending radially inward. The carousel allows selective pivotal deployment of each of the house keys to a deployed position with the distal end extending radially outward through the wall aperture.

An electric motor (not shown) rotates the carousel so as to align each of the house keys with the cover aperture for deployment. An electronic controller controls the motor. The controller has input buttons, a microphone, and a voice recognition circuit responsive to voice commands. Batteries are provided for power. A knob manually rotates the carousel in case the battery is weak.

An electric solenoid (not shown) is connected to the controller and to the battery for selectively deploying each of the house keys. The solenoid is connected to the key by a bellcrank (not shown) and is responsive to commands from the controller.

A handle and a belt clip optionally are attached to the housing. A flashlight is received within the housing rear chamber. The flashlight has an LED and is connected to the battery by a switch (not shown) or by the controller.

These and other aspects, features, and advantages of the present invention will become more readily apparent from the attached drawings and the detailed description of the preferred embodiments, which follow.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
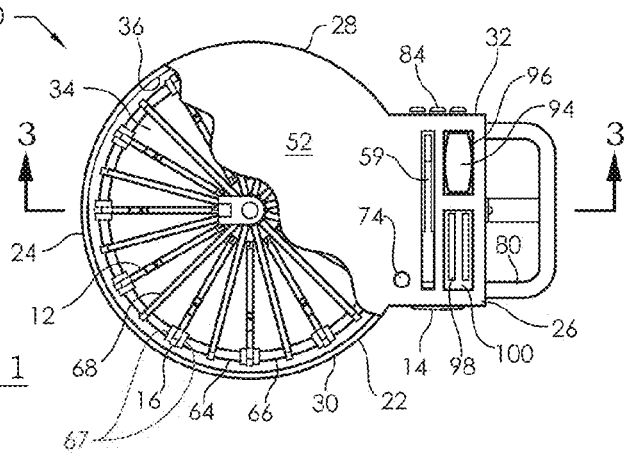
FIG. 1 presents a top plan, partial sectional view of a key holder constructed in accordance with the invention.
Figure 2:
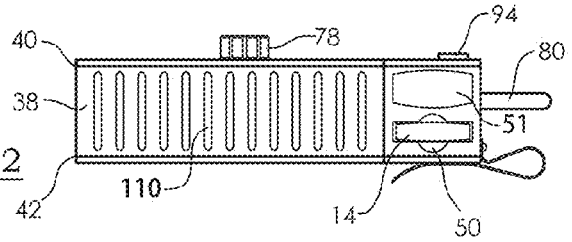
FIG. 2 presents a side elevation view of the key holder of FIG. 1.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1.

Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIGS. 1-4 of the drawings, a key holder is shown at 10 and is for use in connection with a plurality of house keys 12 and at least one car key 14. The car key 14 can be of any of a variety of form factors. Some of the car keys 14 are provided having a commonly recognized key extending from an enlarged key hand grip. Other car keys are provided in a form factor of a key fob 15, which has an electrical interface which interacts with the vehicle for controlling access and ignition thereof. Each of the keys 12, 14 extends from a proximal end 16 having a mounting hole 18 to a distal end 20.

The key holder 10 includes a housing 22 extending between a front 24 and a rear 26, and between a left side 28 and a right side 30. The housing 22 has a rear chamber 32 projecting outward from the housing rear 26. The housing has a circular floor 34 bounded by a periphery 36 and with an annular rim 35 at a central location on the floor 34. The housing 22 has a wall 38 extending around and affixed to the floor periphery 36 and around the rear chamber 32. The wall 38 extends from the floor 34 upward to a wall upper edge 40, and from the floor 34 downward to a wall lower edge 42. The housing 22 has an upper (a main) chamber 44 above the floor 34 and a lower (an auxiliary) chamber 46 below the floor. The wall 38 has a wall aperture 48 through the wall 38 adjacent the housing front 24 and extending from adjacent to the periphery 36 of the floor 34 to the wall upper edge 40. The rear chamber 32 has a car key aperture 50 and or a car key fob aperture 51 through the wall 38. The car key aperture 50 is adapted to receive the car key 14. The car key fob aperture 51 is adapted to receive the key fob 15.

Figure 3A:
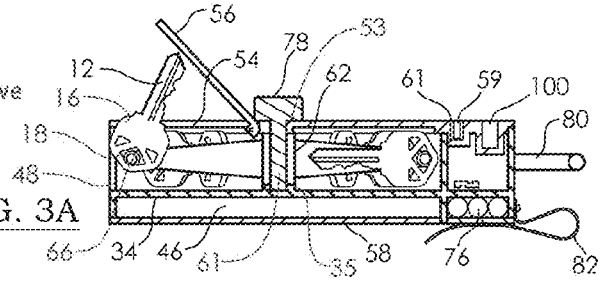
FIG. 3*a* presents a side elevation sectional view of the key holder of FIG. 1, taken along lines 3-3 of FIG. 1, and showing a key being deployed.
Figure 3B:
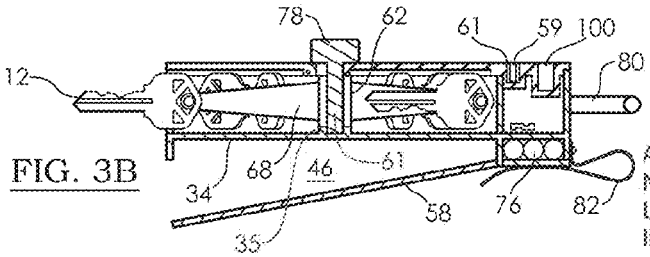
FIG. 3*b* presents a side elevation sectional view of the key holder of FIG. 1, taken along lines 3-3 of FIG. 1, and showing the key fully deployed.
Figure 4:
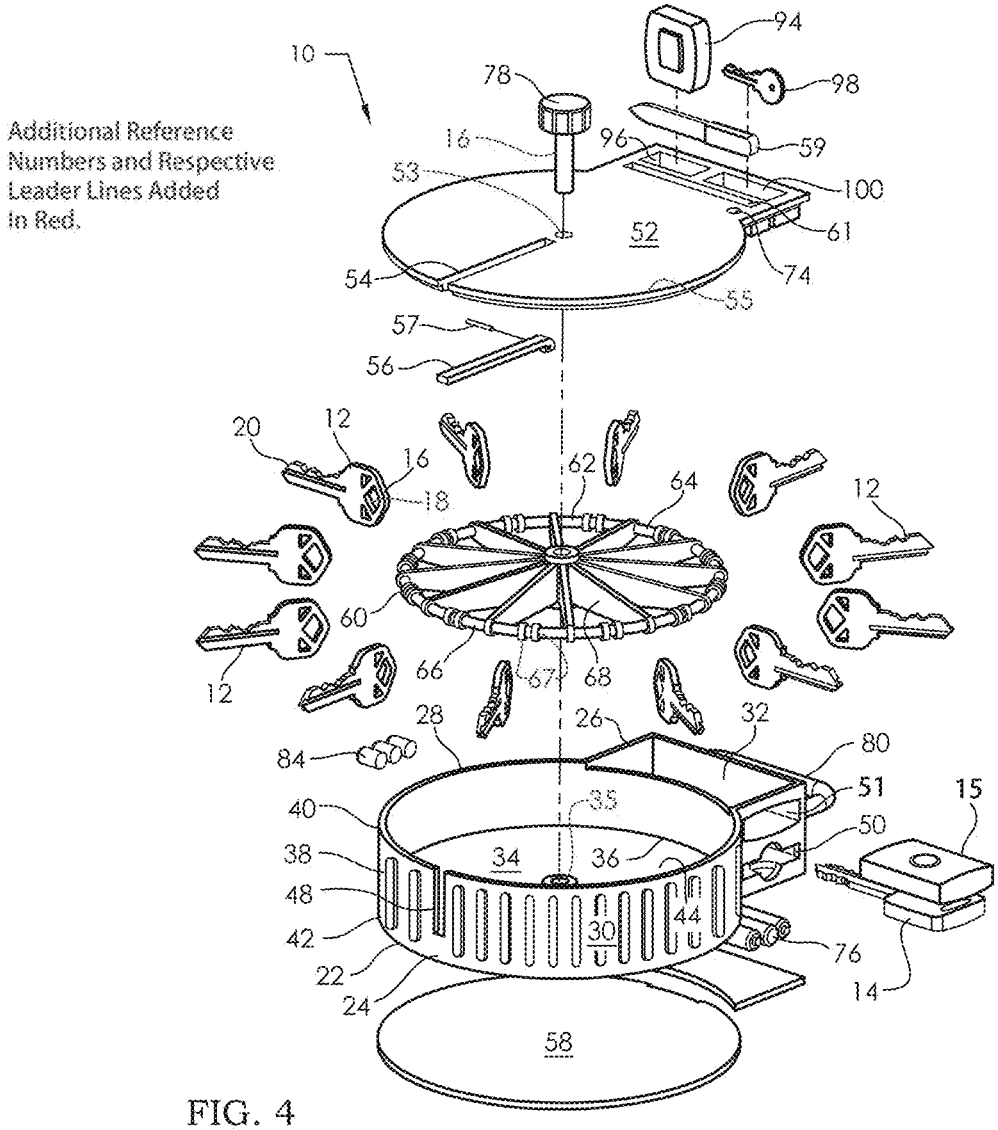
FIG. 4 presents an exploded assembly isometric view of the key holder of FIG. 1, showing the upper aspect.

The key holder 10 also includes a cover 52 that is secured on and thus encloses the top of the rear and main chambers 32, 44 and has a periphery 53 that extends around and overlies the wall upper edge 40. The cover 52 has a central aperture 53 at a central location on the portion of the cover 52 overlying the main chamber 44. The cover 52 also has a cover periphery 55 and a cover aperture 54 through the cover 52. The cover aperture 54 extends radially outward to the cover periphery 55 from adjacent to the central aperture 53, terminating adjacent the housing front 24 and in alignment and open communication with the wall aperture 48. The cover 52 has a cover door 56 being operable to open and close the cover aperture 54. The cover door 56 is shown in FIGS. 3*a*, 3*b*, and 4 as a narrow trap door pivoting on a pin 57 toward and away from the cover aperture 54. An alternative cover door can be an elastomer diaphragm slit down the center.

Figure 5:
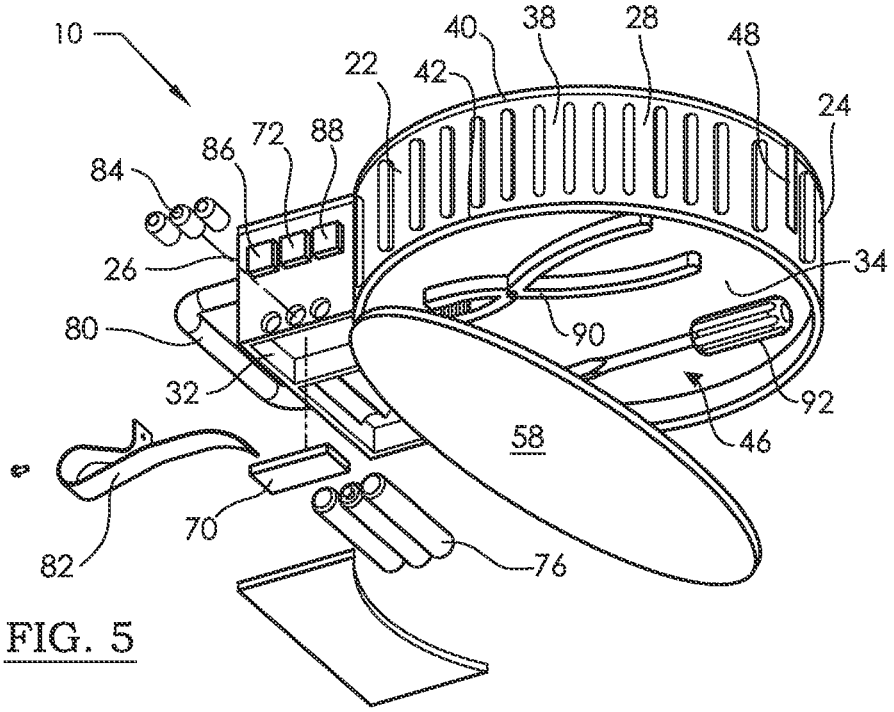
FIG. 5 presents another exploded assembly isometric view of the key holder of FIG. 1, showing the lower aspect.

As shown in FIG. 5, the key holder 10 also includes a lower door 58 that encloses the lower (auxiliary) chamber 46 and extends around the wall lower edge 42. The lower door 58 is pivotally attached to the wall lower edge 42 for pivotal movement between a closed position for closure of the lower chamber 46 and an open position for access to the lower chamber 46. The lower chamber 46 is intended to house a tool kit, such as pliers 90, screwdriver 92, knife (not shown), etc. Certain often used tools; such as a nail file 59 can be stored in a pocket 61 in the rear chamber 32.

Referring again to FIGS. 1-4, the key holder 10 also includes a carousel 60 for moving the keys 12, such as house keys, within and around the main chamber 44 of the housing 22. The carousel 60 is disposed within the upper (main) chamber 44 between the housing floor 34 and the cover 52 and surrounded by the housing wall 38. More particularly, the carousel 60 has a central hub 62 fixedly mounted to a central shaft 61 for rotation within the upper chamber 44, relative to the housing 22 and cover 52, between the central locations on the cover 52 and housing floor 34 so as to enable rotation of the carousel 60 about an axis of rotation extending substantially perpendicular to the cover 52 and housing floor 34 and along a longitudinal axis of the central shaft 61. The carousel 60 also has at its perimeter 64 an annular ring 66 disposed adjacent to extending circumferentially along, and between the floor periphery 36 and the cover periphery 55 and extending around the perimeter 64 of the carousel 60 and through the mounting holes 18 in the proximal ends 16 of the house keys 12 so as to retain each of the keys in a longitudinal edgewise upstanding orientation on the housing floor 34. The annular ring 66 has a plurality of pairs of circular ribs 67 affixed or formed on, extending about, and being spaced apart along the annular ring 66. The circular ribs 67 in each pair thereof are also spaced apart from one another so as to be located at opposite ends of the mounting hole 18 on opposite sides of the proximal end 16 of a respective one of the keys 12 so as to retain the keys 12 in the longitudinal edgewise upstanding orientations on the housing floor 34 and disposed along the annular ring 66. The carousel 60 further has a plurality of spokes 68 extending radially outward from the central hub 62 and disposed between and coupled with the central hub 62 and the annular ring 66. The central shaft 61 and the central hub 62, and the plurality of spokes 68 and the annular ring 66 of the carousel 60 adapt the carousel to store and mount the keys 12 in the longitudinal edgewise upstanding orientations with the proximal ends 16 adjacent the annular ring 66 and the distal ends 20 extending radially inward between, and in an angular spaced relationship about, the floor periphery 36 and the central locations of the cover 52 and housing floor 34. At its lower end the central shaft 61 is inserted into the annular rim 35 at the central location on the housing floor 34 and is rotatable relative thereto. A rotational control member in the form of a knob 78 is affixed on an upper end of the central shaft 61 such that the carousel 60 is further adapted to be manually rotated, relative to the housing 22 and cover 52, to allow selective placement of each of the house keys 12, being moved by the carousel 60, in alignment with the cover and wall apertures 54, 48 and thereby permit selective pivotal deployment of each of the house keys 12, while retained in the longitudinal edgewise upstanding orientation, about and relative to the annular ring 66, being entirely disposed within the upper chamber 44 of the housing 22, and through the cover and wall apertures 54, 48 to a deployed position with the distal end 20 of the deployed key 12 extending radially outward through the wall aperture 48 and with the proximal end 16 of the deployed key remaining mounted on the annular ring 66 of the carousel 60 still entirely disposed within the upper chamber 44 of the housing 22. In the radially outward extending deployed position of the distal end 20 of the deployed key 12, the key holder 10 may be gripped and the deployed key 12 used to lock or unlock its corresponding assigned lock mechanism (not shown). An alternative embodiment (not shown) would mount the keys for sliding motion in a radial direction.

An alternative rotational control member in the form of an electronic controller 70 may be provided for selectively rotating the carousel 60 so as to align each of the house keys 12 with the cover aperture 54, and thereby also with the housing wall aperture 48, for deployment. Specifically, in using the electronic controller 70 an electric motor (not shown) rotates the carousel 60. The electronic controller 70 is connected to the motor for controlling the motor. The controller 70 has at least one input button 72 for manually inputting commands. The controller 70 has a microphone 74 and a voice recognition circuit responsive to voice commands. One or more batteries 76 are provided for powering the controller 70 and motor. The knob 78 on the central shaft 61 may also be used for manually rotating the carousel 60 in case the battery is weak.

One or more deployment mechanisms are provided for selectively deploying each of the house keys 12. Typically, at least one electric solenoid (not shown) is connected to the controller 70 and to the battery 76. The solenoid is connected to the key 12 by a bellcrank (not shown) or similar mechanism well known by those skilled in the art. The solenoid is responsive to commands from the controller 70.

Figure 6:
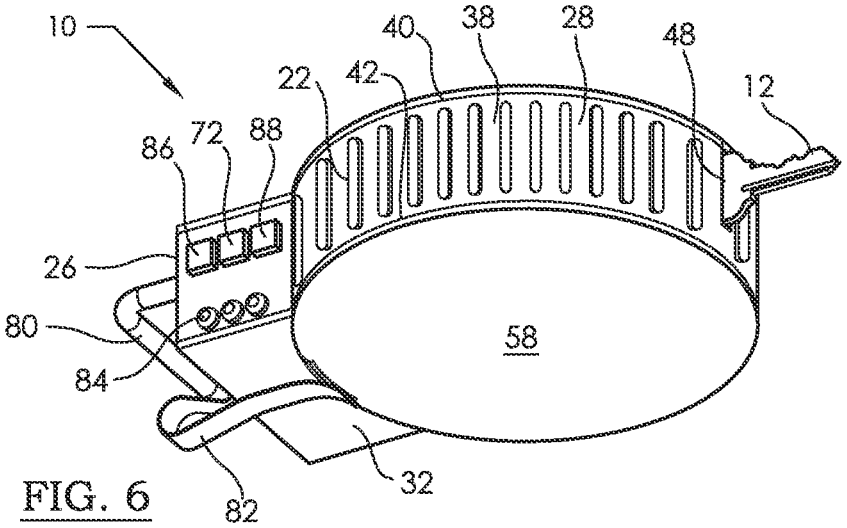
FIG. 6 presents a collapsed assembly isometric view of the key holder of FIG. 1, showing the lower aspect with a key deployed.

Referring now to FIGS. 5 and 6, The key holder 10 may have a handle 80 attached to the housing 22 for manual grasping. Also, a belt clip 82 optionally can be attached to the housing 22 for hanging the key holder 10 from a belt. The key holder 10 may have additional optional features as described in the following paragraphs.

A flashlight 84 is received within the housing rear chamber 32. The flashlight 84 has at least one bulb, preferably a light-emitting diode, or LED. The flashlight 84 is connected to the battery 76 by a switch 86 or by the controller 70.

A garage door opener button 88 actuates a garage door opener circuit built into the controller 70. The operating frequency can be adjusted for the particular garage door opener installed.

A car remote starter 94 is received in a pocket 96 in the housing rear chamber 32. A variety of car remote starters 94 are available commercially.

Certain keys 98 of an odd shape or size will not fit into the carousel 60, or will not deploy properly. An odd key pocket 100 is provided in the housing rear chamber 32 to accommodate the odd key 98.

A grip 110 can be provided upon an exterior surface of the housing 22 to aid in gripping the key holder 10. The grip 110 can be of any reasonable design and material. The exemplary grip 110 comprises a series of ribs formed of a rubber material.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications that will come within the scope of the appended claims is reserved.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A key holder for use in connection with a plurality of keys, each key defined having a proximal end located at a first elongated end and a distal end located at an opposite elongated end, each key comprising a mounting hole located proximate the proximal end thereof, the key holder comprising:

a housing, the housing comprising:

a circular floor having a central location thereon, the floor being bound by a floor periphery, a housing wall extending perpendularly from the floor periphery at a location between an upper edge of the housing wall and a lower edge of the housing wall forming a main chamber above the floor, and a wall aperture formed through the housing wall, the wall aperture extending between the floor periphery and the housing wall upper edge;

a cover enclosing the main chamber and having a cover periphery extending around the wall upper edge, the cover having a central location thereon and a cover aperture formed therethrough, the cover aperture extending radially outward from adjacent to the central location of the cover to the cover periphery and aligned in open communication with the wall aperture;

a carousel for moving the plurality of keys within and around the main chamber of the housing and relative to the cover and the housing, the carousel comprising:

a central hub rotatably mounted within the main chamber between the respective central locations on the cover and the housing floor so as to enable rotation of the carousel, relative to the cover and the housing, about an axis extending substantially perpendicular to the cover and the housing floor, an annular ring disposed adjacent to, extending circumferentially along and between the floor periphery and the cover periphery, and extending through the mounting holes in the proximal ends of the keys so as to retain the keys in respective longitudinal edgewise upstanding orientations on the housing floor, and a plurality of spokes extending radially outward from the central hub and disposed between and coupled with the central hub and the annular ring, wherein together the central hub, the annular ring and the spokes adapt the carousel to store and mount the keys in the respective longitudinal edgewise upstanding orientations with the proximal ends of the keys being mounted on the annular ring and the distal ends of the keys extending away from the annular ring towards the central hub and with the keys radially disposed relative to the central hub and between, and in an angular spaced relationship about, the floor periphery and the cover periphery, and wherein together the central hub, the annular ring and the spokes further adapt the carousel to be rotated, relative to the cover and the housing, about the rotation axis to move the keys into selective placement of each of the keys in alignment with the cover aperture and the housing wall aperture and thereby allow selective pivotal deployment of the each of the keys, while being retained in the longitudinal edgewise upstanding orientation, about and relative to the annular ring, being entirely disposed within the main chamber of the housing, and through the cover aperture and the housing wall aperture to a deployed position with the distal end of the deployed key extending radially outward through the housing wall aperture and with the proximal end of the deployed key remaining mounted on the annular ring of the carousel still entirely disposed within the main chamber of the housing;

a rotational control member for selectively rotating the carousel so as to align the each of the keys with the cover aperture, and thereby with the wall aperture, for deployment; and at least one deployment mechanism, wherein the deployment mechanism aids in selectively deploying the each of the keys.

2. A key holder as recited in claim 1, wherein the cover aperture extends radially outward terminating at a location adjacent to the housing front; and a cover door operatively attached to the cover at a location to close the cover aperture and being convertible to open the cover aperture.

3. A key holder as recited in claim 1, wherein:

the carousel further comprising:

an annular rim at the central location on the housing floor; and a central shaft extending between the central locations on the cover and the housing floor and being rotatable relative to, and at a lower end inserted into, the annular rim, the central hub being fixedly mounted to the central shaft; and the rotational control member comprising:

a knob affixed on an upper end of the central shaft such that the carousel is adapted to be manually rotated by the knob, relative to the cover and housing, to move the keys and allow the selective placement and pivotal deployment of each of the keys.

4. A key holder as recited in claim 1, wherein one of the keys is a car key having a remote keyless-entry key fob, the key holder further comprising:

a rear chamber projecting outward from the housing rear, the housing wall extending around the periphery and around the rear chamber;

a car key aperture through the wall, the car key aperture being adapted to receive the car key; and a key fob aperture through the wall, the key fob aperture being adapted to receive the key fob.

5. A key holder as recited in claim 1, further comprising a car remote starter received in the housing rear chamber.

6. A key holder as recited in claim 1, further comprising:

an electronic controller connected to the rotational control member and the deployment mechanism, the controller having at least one input button for manually inputting commands to the controller, the controller having a microphone and a voice recognition circuit responsive to voice commands, the controller having a garage door opener circuit; and at least one battery for powering the controller, the rotational control member, and the deployment mechanism.

7. A key holder as recited in claim 1, further comprising a flashlight received within the housing.

8. A key holder as recited in claim 1, further comprising:

a lower chamber below the floor for storage of tools; and a lower door enclosing the lower chamber and extending around the wall lower edge, the lower door being pivotally attached to the wall lower edge for pivotal movement between a closed position for closure of the lower chamber and an open position for access to the lower chamber.

9. A key holder as recited in claim 1, further comprising:

a handle attached to the housing for manual grasping;

a belt clip attached to the housing for hanging the key holder from a belt; and a grip material applied to an exterior surface of the housing wall to aid the user in gripping the housing wall.

10. A key holder for use in connection with a plurality of keys, one of the keys being a car key including a remote keyless-entry key fob, each key defined having a proximal end located at a first elongated end and a distal end located at an opposite elongated end, each key comprising a mounting hole located proximate the proximal end thereof, the key holder comprising:

a housing, the housing comprising:

a circular floor having a central location thereon, the floor being bound by a floor periphery, a housing wall extending perpendularly from the floor periphery at a location between an upper edge of the housing wall and a lower edge of the housing wall forming a main chamber above the floor, a wall aperture formed through the housing wall, the wall aperture extending between the floor periphery and the housing wall upper edge, a rear chamber projecting outward from the rear portion of the housing, a car key aperture formed through the housing wall at the rear chamber, the car key aperture being adapted to receive the car key, a key fob aperture extending through a wall of the rear chamber, the key fob aperture being adapted to receive the key fob;

a cover enclosing the main chamber and having a cover periphery extending around the wall upper edge, the cover having a central location thereon and a cover aperture formed therethrough, the cover aperture extending radially outward from adjacent to the central location of the cover to the cover periphery, terminating at a location adjacent to the housing front and aligned in open communication with the wall aperture;

a cover door operatively attached to the cover at a location to close and close the cover aperture;

a carousel for moving the plurality of keys within and around the main chamber of the housing and relative to the cover and the housing, the carousel comprising:

a central hub rotatably mounted within the main chamber between the respective central locations on the cover and the housing floor so as to enable rotation of the carousel, relative to the cover and the housing, about an axis extending substantially perpendicular to the cover and the housing floor, an annular ring disposed adjacent to, extending circumferentially along and between the floor periphery and the cover periphery, and extending through the mounting holes in the proximal ends of the keys so as to retain the keys in respective longitudinal edgewise upstanding orientations on the housing floor, and a plurality of spokes extending radially outward from the central hub and disposed between and coupled with the central hub and the annular ring, wherein together the central hub, the annular ring and the spokes adapt the carousel to store and mount the keys in the longitudinal edgewise upstanding orientations with the proximal ends of the keys being mounted on the annular ring and the distal ends of the keys extending away from the annular ring towards the central hub and with the keys radially disposed relative to the central hub and between, and in an angular spaced relationship about, the floor periphery and the cover periphery, and wherein together the central hub, the annular ring and the spokes further adapt the carousel to be rotated, relative to the cover and the housing, about the rotation axis to move the keys into selective placement of each of the keys in alignment with the cover aperture and the housing wall aperture and thereby allow selective pivotal deployment of the each of the keys, while retained in the longitudinal edgewise upstanding orientation, about and relative to the annular ring, being entirely disposed within the main chamber of the housing, and through the cover aperture and the housing wall aperture to a deployed position with the distal end of the deployed key extending radially outward through the housing wall aperture and with the proximal end of the deployed key remaining mounted on the annular ring of the carousel still entirely disposed within the main chamber of the housing;

a rotational control member for selectively rotating the carousel so as to align the each of the keys with the cover aperture, and thereby with the wall aperture, for deployment; and at least one deployment mechanism, wherein the deployment mechanism aids in selectively deploying the each of the keys.

11. A key holder as recited in claim 10, wherein:

the carousel further comprising:

an annular rim at the central location on the housing floor; and a central shaft extending between the central locations on the cover and the housing floor and being rotatable relative to and at a lower end inserted into, the annular rim, the central hub being fixedly mounted to the central shaft; and the rotational control member comprising:

a knob affixed on an upper end of the central shaft such that the carousel is adapted to be manually rotated by the knob, relative to the cover and housing, to move the keys and allow the selective placement and pivotal deployment of each of the keys.

12. A key holder as recited in claim 10, further comprising a car remote starter received in the housing rear chamber.

13. A key holder as recited in claim 10, further comprising:

an electronic controller connected to the rotational control member and the deployment mechanism, the controller having at least one input button for manually inputting commands to the controller, the controller having a microphone and a voice recognition circuit responsive to voice commands, the controller having a garage door opener circuit; and at least one battery for powering the controller, the rotational control member, and the deployment mechanism.

14. A key holder as recited in claim 10, further comprising a flashlight received within the housing.

15. A key holder as recited in claim 10, further comprising:

a lower chamber below the floor for storage of tools; and a lower door enclosing the lower chamber and extending around the wall lower edge, the lower door being pivotally attached to the wall lower edge for pivotal movement between a closed position for closure of the lower chamber and an open position for access to the lower chamber.

16. A key holder as recited in claim 10, further comprising:

a handle attached to the housing for manual grasping;

a belt clip attached to the housing for hanging the key holder from a belt; and a grip material applied to an exterior surface of the housing wall to aid the user in gripping the housing wall.

17. A key holder for use in connection with a plurality of house keys and at least one car key including a remote keyless-entry key fob, each key defined having a proximal end located at a first elongated end and a distal end located at an opposite elongated end, each key comprising a mounting hole located proximate the proximal end thereof, the key holder comprising:

a housing, the housing comprising:

a circular floor bound by a floor periphery, a housing wall extending perpendularly from the floor periphery at a location between an upper edge of the housing wall and a lower edge of the housing wall forming an upper chamber above the floor and a lower chamber below the floor, a wall aperture formed through the housing wall, the wall aperture extending between the floor and the housing wall upper edge, a rear chamber projecting outward from the rear portion of the housing, a car key aperture formed through the housing wall, the car key aperture being adapted to receive the car key, a key fob aperture extending through a wall of the rear chamber, the key fob aperture being adapted to receive the key fob;

a cover enclosing the upper chamber and extending around the wall upper edge, the cover having a cover aperture formed therethrough, the cover aperture extending radially outward terminating at a location adjacent to the housing front, a cover door operatively attached to the cover at a location to close the cover aperture;

a lower door enclosing the lower chamber and extending around the wall lower edge, the lower door being operatively attached to the housing for operatively movement between a closed position for closure of the lower chamber and an open position for access to the lower chamber;

a carousel rotatably mounted within the upper chamber and enabling rotation about an axis substantially perpendicular to the circular floor therein, the carousel being adapted to store the keys in a storage position and adapted to allow selective deployment of the each of the keys to a deployed position with the distal end extending radially outward through the wall aperture;

a plurality of key attachment members for mounting each of the keys in angular spaced relation around the carousel perimeter;

a rotational control member for selectively rotating the carousel so as to align the each of the house keys with the cover aperture for deployment;

at least one deployment mechanism for selectively deploying the each of the house keys;

an electronic controller connected to the rotational control member and the deployment mechanism, the controller having at least one input button for manually inputting commands to the controller, the controller having a microphone and a voice recognition circuit responsive to voice commands, the controller having a garage door opener circuit; and at least one battery for powering the controller, the rotational control member, and the deployment mechanism.

18. A key holder as recited in claim 17, further comprising a car remote starter received in the housing rear chamber.

19. A key holder as recited in claim 17, further comprising a flashlight received within the housing.

20. A key holder as recited in claim 17, further comprising:

a handle attached to the housing for manual grasping;

a belt clip attached to the housing for hanging the key holder from a belt; and a grip material applied to an exterior surface of the housing wall to aid the user in gripping the housing wall.

21. A key holder as recited in claim 1, wherein said annular ring of the carousel has a plurality of pairs of circular ribs spaced apart along the annular ring and provided on and extending about the annular ring, the circular ribs in each pair thereof being spaced apart from one another so as to be located at opposite ends of the mounting hole on opposite sides of the proximal end of a respective one of the keys so as to retain the keys in the respective longitudinal edgewise upstanding orientations on the housing floor and disposed circumferentially and angularly spaced along the annular ring.

22. A key holder as recited in claim 10, wherein said annular ring of the carousel has a plurality of pairs of circular ribs spaced apart along the annular ring and provided on and extending about the annular ring, the circular ribs in each pair thereof being spaced apart from one another so as to be located at opposite ends of the mounting hole on opposite sides of the proximal end of a respective one of the keys so as to retain the keys in the respective longitudinal edgewise upstanding orientations on the housing floor and disposed circumferentially and angularly spaced along the annular ring.

* * * * *